US007729644B2

(12) United States Patent
Thornton et al.

(10) Patent No.: US 7,729,644 B2
(45) Date of Patent: Jun. 1, 2010

(54) TONER CARTRIDGE

(75) Inventors: William A. Thornton, Prior Lake, MN (US); Michael A. Kleiter, Savage, MN (US); Kin Yip Ho, Kowloon (HK); Zhi Ya He, Zhuzhou (CN)

(73) Assignee: Katun Corporation, Minneapolis, MN (US)

( * ) Notice: Subject to any disclaimer, the term of this patent is extended or adjusted under 35 U.S.C. 154(b) by 465 days.

(21) Appl. No.: 11/432,289

(22) Filed: May 11, 2006

(65) Prior Publication Data

US 2007/0264055 A1 Nov. 15, 2007

(51) Int. Cl.
*G03G 15/08* (2006.01)

(52) U.S. Cl. ..... 399/262; 399/263

(58) Field of Classification Search ..... 399/258, 399/260, 262–263, 120
See application file for complete search history.

(56) References Cited

U.S. PATENT DOCUMENTS

| | | | | |
|---|---|---|---|---|
| 5,528,349 | A | 6/1996 | Satake | |
| 5,669,044 | A * | 9/1997 | Cuthbert | 399/120 |
| 5,774,773 | A * | 6/1998 | Otsuka et al. | 399/262 |
| 5,794,108 | A * | 8/1998 | Yoshizawa et al. | 399/262 |
| 5,828,935 | A * | 10/1998 | Tatsumi et al. | 399/260 |
| 5,890,040 | A | 3/1999 | Matsuoka et al. | |
| 5,903,806 | A | 5/1999 | Matsuoka et al. | |
| 6,049,685 | A * | 4/2000 | Murakami et al. | 399/263 |
| 6,064,846 | A | 5/2000 | Wang et al. | |
| 6,104,902 | A * | 8/2000 | Meyer et al. | 399/262 |
| 6,128,453 | A | 10/2000 | Ban et al. | |
| 6,134,411 | A * | 10/2000 | Meyer et al. | 399/262 |
| 6,256,470 | B1 | 7/2001 | Taniyama et al. | |
| 6,334,037 | B1 * | 12/2001 | Ise | 399/262 |
| 6,591,078 | B2 | 7/2003 | Ban et al. | |
| 6,594,458 | B2 | 7/2003 | Ban et al. | |
| 6,792,228 | B2 | 9/2004 | Ban et al. | |
| 6,853,828 | B2 | 2/2005 | Ban et al. | |
| 6,879,789 | B2 | 4/2005 | Yamada et al. | |
| 6,920,298 | B2 | 7/2005 | Yamada et al. | |
| 6,922,540 | B2 | 7/2005 | Yoshikawa et al. | |

(Continued)

FOREIGN PATENT DOCUMENTS

| | | | |
|---|---|---|---|
| EP | 1233311 | A2 | 8/2002 |

(Continued)

*Primary Examiner*—David M Gray
*Assistant Examiner*—Geoffrey T Evans
(74) *Attorney, Agent, or Firm*—Schwegman, Lundberg & Woessner, P.A.

(57) ABSTRACT

A toner cartridge including a container body having a discharge opening. A drive transmitting member is fixedly coupled with the container body near the discharge opening. The drive transmitting member is sized and shaped to transmit rotational movement to the container body. A collar is moveably coupled along the container body, and the collar closes the discharge opening in a first position, and opens the discharge opening in a second position. The cartridge further includes, in one example, a biasing element sized and shaped to bias the collar toward the first position. In another example, the drive transmitting member includes at least one deflectable support member, and the deflectable support member includes a ramped drive element. The ramped drive element includes a first ramp face, a second ramp face, and at least one driving face. Optionally, the first and second ramp faces are sloped with respect to the support member.

34 Claims, 12 Drawing Sheets

U.S. PATENT DOCUMENTS 6,934,494 B2 8/2005 Yamada et al.
6,944,417 B2 9/2005 Yamada et al.
6,947,690 B2 9/2005 Tazawa
6,952,549 B2 10/2005 Kato et al.
6,968,139 B2 11/2005 Ban et al.
6,980,754 B2 12/2005 Isomura et al.
6,990,301 B2 1/2006 Yamada et al.
6,993,273 B2 1/2006 Yamada
7,039,347 B2 5/2006 Yamada et al.
7,079,788 B2 7/2006 Ban et al.
7,088,942 B2 8/2006 Minagawa
7,110,709 B2 9/2006 Kato et al.
7,116,929 B2 10/2006 Yamada
7,116,931 B2 10/2006 Yamada et al.
7,127,193 B2 10/2006 Yamada et al.
7,155,138 B2 12/2006 Yamada
7,209,686 B2 4/2007 Yamada
7,324,777 B2 1/2008 Yamada et al.
7,325,385 B2 2/2008 Nagashima et al.
7,352,975 B2 4/2008 Fujiwara et al.
7,376,369 B2 5/2008 Yamada et al.
7,382,997 B2 6/2008 Yamada et al.
7,386,251 B2 6/2008 Yamada et al.
7,391,999 B2 6/2008 Yamada
7,430,384 B2 9/2008 Yamada et al.
7,433,633 B2 10/2008 Yamada et al.
7,469,113 B2 12/2008 Yamada et al.
7,474,866 B2 1/2009 Doi et al.
7,606,518 B2 * 10/2009 Koyama ..... 399/258
2003/0223782 A1 * 12/2003 Ban et al. ..... 399/227
2004/0223790 A1 * 11/2004 Hosokawa et al. ..... 399/258
2009/0154956 A1 * 6/2009 Yamada ..... 399/120
2009/0232546 A1 * 9/2009 Yamada et al. ..... 399/119

FOREIGN PATENT DOCUMENTS

JP 2002-318490 A 10/2002
JP 2005092240 A * 4/2005

* cited by examiner

TONER CARTRIDGE

TECHNICAL FIELD

Toner containers and in particular rotatable toner containers.

BACKGROUND

Photocopiers use a variety of replaceable toner cartridges to provide toner to image forming mechanisms. In some examples, toner cartridges include feeding members, such as augers, sweeping blades and the like that rotate to move toner within the toner cartridge toward a discharge opening and from there into the image forming apparatus. In other examples, the toner cartridge is rotated and includes features therein that move the toner toward the toner discharge opening. Many rotatable toner cartridges include drive transmission features that communicate rotational motion from a driving mechanism in the photocopier to the toner cartridge, and thereby rotate the cartridge. These drive transmission features, in yet other examples, transmit rotational force directly to the toner cartridge filled with toner. The inertia of the filled cartridge is considerable and in some cases the drive transmission features fail because of corresponding rotational stresses, substantially preventing rotation of the cartridge and dispensing of toner. Additionally, a failed drive transmission feature may be difficult to remove from the photocopier and require considerable maintenance before another toner cartridge may be used.

In still other examples, rotatable toner cartridges include drive coupling members with the drive transmission features, and the drive coupling members are at least partially disengageable from the cartridges while the cartridges are in use. In one example, the drive coupling member is pulled away from the toner cartridge to form a toner discharge opening between the drive coupling member and the toner cartridge. The drive coupling member is moveably coupled with the toner cartridge by supports that extend therebetween and allow for discharge of toner. Similarly to the drive transmission feature, described above, the supports experience significant rotational stress because of the inertia of the filled toner cartridge and may experience failure. Moreover, the drive coupling member and supports must be carefully designed and manufactured to properly engage with the toner cartridge and the driving mechanism of the image forming apparatus to provide the desired size for the discharge opening and correctly position the toner cartridge in the image forming apparatus for rotation. Manufacturing of a toner cartridge with moveable parts that require careful dimensioning, as described above, is expensive and time consuming. Additionally, the disengaged drive coupling member can misalign with the toner cartridge when the image forming apparatus attempts to close the cartridge. The misalignment causes spilling of toner from the cartridge as it is removed from the image forming apparatus.

In yet other examples, toner cartridges include feeding members that are immobile with respect to the cartridge and move toner through the toner cartridge as the cartridge is rotated. For example, at least some toner cartridges include a lattice work feeding member that extends across a diameter of the cartridge. The feeding member includes a complicated arrangement of ramps, projections and through holes that transport toner toward the discharge opening of the cartridge. Toner is scooped by the ramp and projection and slides down the ramp and projection toward the discharge opening. At least some of the scooped toner falls through the through hole to fluidize the toner within the cartridge and prevent toner clumping. The lattice work feeding member requires complicated molding and/or machining and must be coupled within the interior of the toner cartridge. Forming the lattice work feeding member is therefore expensive and requires additional labor to install within the cartridge.

The present inventors have recognized that what is needed are toner cartridges and methods for making the same that address the above issues. The present inventors have further recognized that what is needed is a toner cartridge that maintains a minimum of easily manufactured parts and a minimum number of drive transmitting parts that are moveable with respect to the cartridge.

DETAILED DESCRIPTION

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, logical and electrical changes may be made without departing from the scope of the present invention. The following detailed description is, therefore, not to be taken in a limiting sense, and the scope of the present invention is defined by the appended claims and their equivalents.

Figure 1:
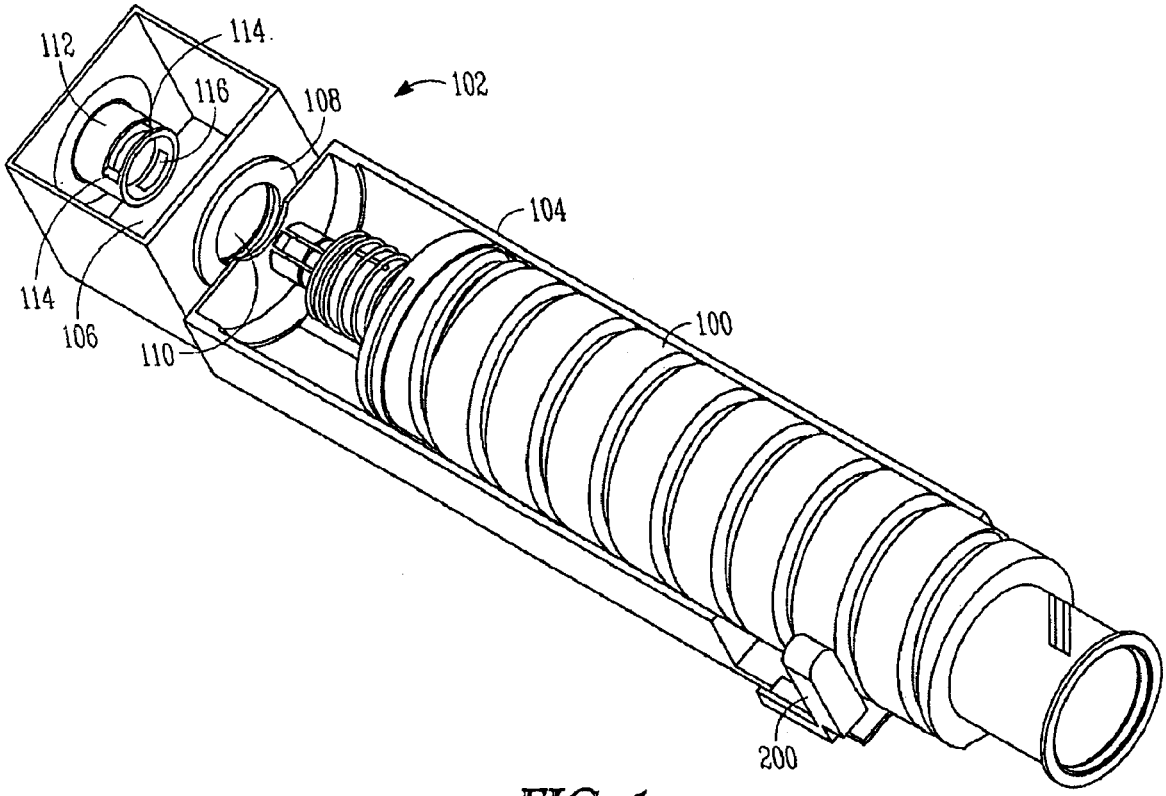
FIG. 1 is a perspective view showing one example of a toner cartridge prior to coupling with a toner hopper.

FIG. 1 shows one example of a container for storing and dispensing a toner, developer, developing solution and the like, such as toner cartridge 100, prior to coupling with a toner hopper 102 of an image forming apparatus, such as a xerographic image forming machine. The toner hopper 102 includes a cartridge tray 104 sized and shaped to receive the toner cartridge 100 and facilitate rotation of the toner cartridge 100. The toner hopper 102 further includes a toner chute 106. A drive transmitting member orifice 110 extends through the toner chute 106 and is sized to receive a drive transmitting member (described below) of the toner cartridge 100. A drive coupling 112 extends into the toner chute 106. The drive coupling 112 is sized and shaped to engage with the drive transmitting member of the cartridge and rotate the toner cartridge 100.

Figure 2:
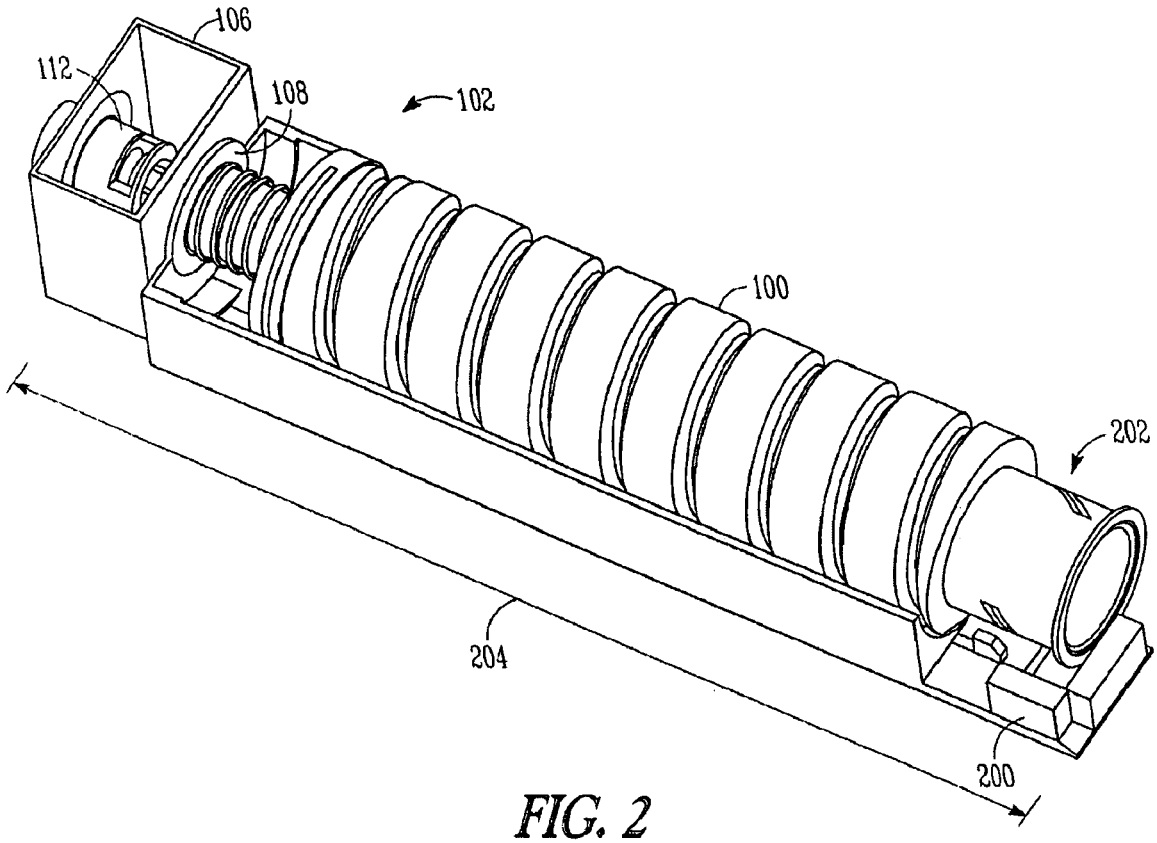
FIG. 2 is a perspective view showing the toner cartridge coupled with the toner hopper.

Referring now to FIG. 2, the toner cartridge 100 is shown coupled with the toner hopper 102. A locking lever 200 of the toner hopper 102 is rotated from a first position shown in FIG. 1 to a second position (FIG. 2) and engages with a proximal end 202 of the toner cartridge 100. As further described below, the locking lever 200 of the toner hopper 102 retains the toner cartridge 100 in the coupled state shown in FIG. 2 with the toner hopper 102. Once the locking lever 200 is rotated into the second position, the toner cartridge is positioned to rotate with rotation of the drive coupling 112 and discharge toner into the toner chute 106.

Figure 3:
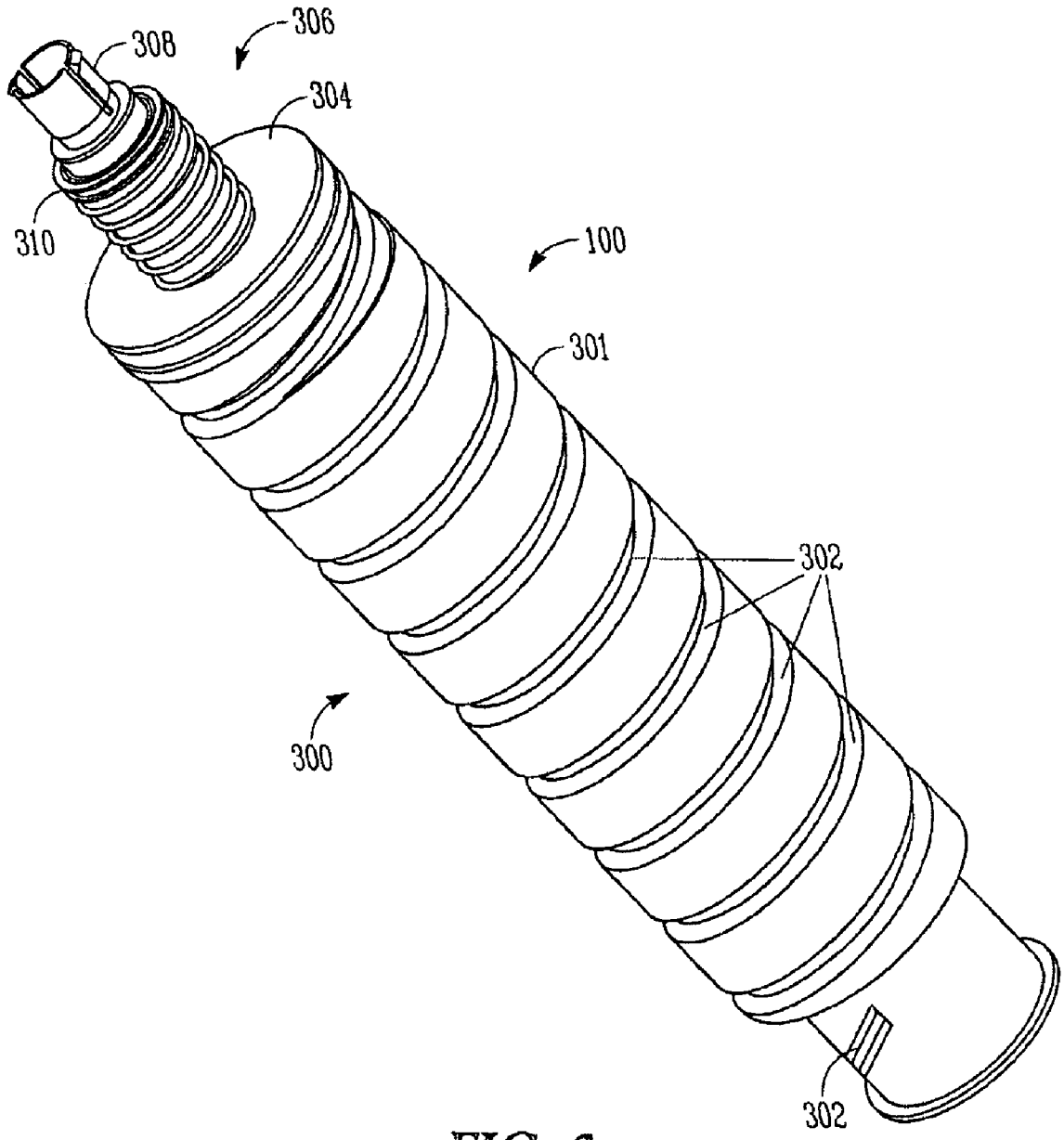
FIG. 3 is a perspective view of one example of a toner cartridge with a collar in a closed position.
Figure 4:
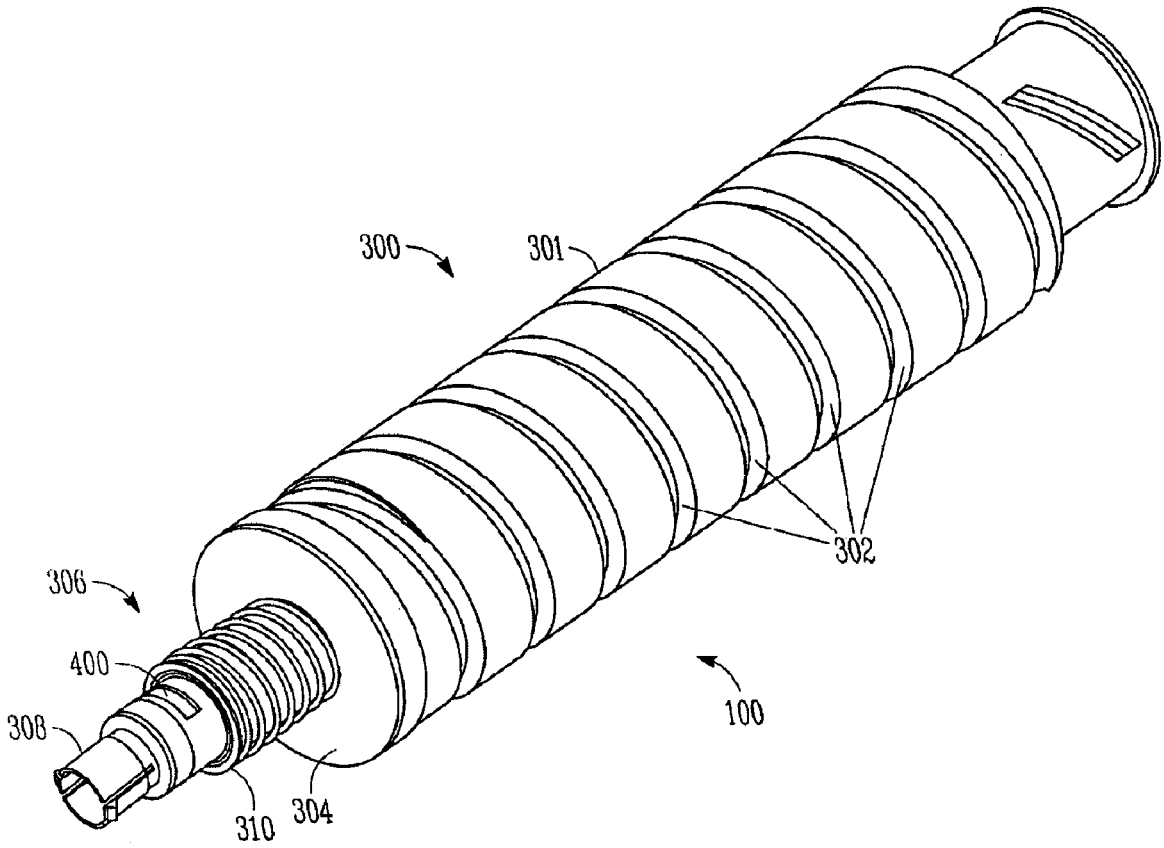
FIG. 4 is a perspective view of the toner cartridge with the collar in an open position.

An example of the toner cartridge 100 is shown in FIGS. 3 and 4 in a first closed position and a second open position, respectively. The toner cartridge 100 includes a container body 300. The container body 300 stores particulate matter, such as an image forming toner, developer, developing solution and the like. In one example, at least a portion of the container body 300 is formed by blow molding a plastic including, but not limited to, polyethylene, high density polyethylene, polyether terephthalate, polypropolene and the like. The container body 300 includes a neck portion 304, near a distal end 306 of the toner cartridge 100. The neck portion 304, in another example, is formed by injection molding, and coupled with the storage portion 301 of the container body 300 with mechanical fasteners, adhesives, welding and the like. Optionally, the neck portion 304 is coupled with the storage portion 301 after the storage portion 301 is filled with toner. In one option, where the neck portion 304 is coupled with the storage portion 301 using an adhesive or similar permanent means of coupling, refilling the cartridge 100 is made difficult because the cartridge 100 must be physically damaged in order to open the cartridge for refilling. Therefore counterfeiting of the toner cartridge 100 is made more difficult.

Figure 6:
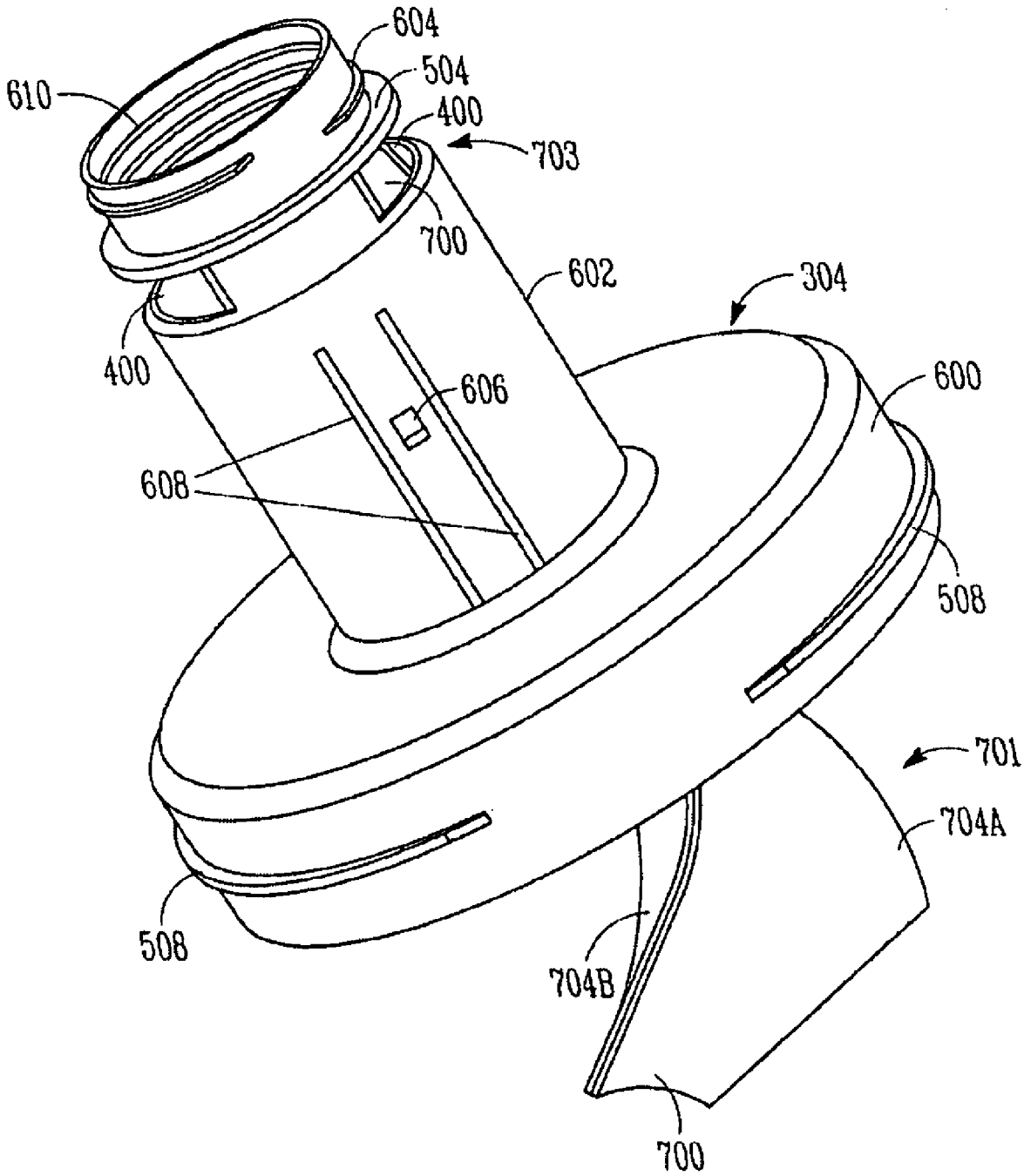
FIG. 6 is a perspective view of one example of a neck portion of a container body.

The container body 300 includes at least one feeding member adapted to move toner through the container body 300 toward a toner discharge opening 400 (the example toner cartridge 100 includes a plurality of openings 400 as shown in FIG. 6). As shown in FIGS. 3 and 4, a feeding member 302 includes a spiral projection extending into the interior of the storage portion 301. Rotation of the toner cartridge 100 forces the toner within the storage portion 301 to slide along the feeding member 302 and feed toward the discharge opening 400. In another example, a feeding member includes a helical blade, multiple spiral projections, opposed projections and the like, adapted to move toner through the container body 300 toward the discharge opening 400.

As shown in FIGS. 3 and 4, the toner cartridge 100 includes a drive transmitting member 308 coupled with the neck portion 304 near the discharge opening 400. Optionally, the drive transmitting member 308 has a larger perimeter than a perimeter of the toner discharge opening 400. The drive coupling 112 of the toner hopper 102 (FIGS. 1 and 2) is sized and shaped to receive the drive transmitting member 308 and supply rotation to the member 308 and correspondingly the toner cartridge 100. The drive transmitting member 308, in one example, is fixedly coupled to the neck portion 304 of the container body 300, with, for instance, welding, adhesives, mechanical fasteners and the like. The drive transmitting member is thereby constrained from moving with respect to the container body 300 and directly transmits rotation (from the drive coupling 112) to the container body 300. Because the drive transmitting member 308 is fixedly coupled with the container body 300, a robust coupling is achieved that minimizes stresses between the container body 300 and the member 308, thereby lessening the chance of failure of the toner cartridge 100. Additionally, fixedly coupling the drive transmitting member 308 with the container body 300 eliminates precise manufacturing needed between a sealing member that separates from the container body 300 to open the body 300 to discharge toner. The member 308 is not a sealing member used to open the discharge opening 400 and therefore does not need such expensive and precise manufacturing.

In this example of the toner cartridge 100, the cartridge further includes a shutter, such as the collar 310. The collar 310 is movable from a first closed position (FIG. 3) to a second open position (FIG. 4) that exposes the toner discharge opening 400. In one example, the collar 310 is slidable along the neck portion 304. In another example, the collar 310 is snugly coupled around the neck portion 304 to form a tight seal around the discharge opening 400 when the collar 310 is in the first closed position shown in FIG. 3. The collar 310 substantially prevents escape of toner from within the toner cartridge until the collar 310 is moved to the second open position shown in FIG. 4. Optionally, as described below, the toner cartridge 100 includes a gasket interposed between the collar 310 and the neck portion 304 near the discharge opening 400 to further ensure toner is unable to escape the closed cartridge 100. In yet another option, the collar 310 extends only part way around the cartridge 100 (e.g., the neck portion 400). In still another option, the collar 310 is movably coupled with the cartridge 100 along an interior of the neck portion 304.

Figure 5:
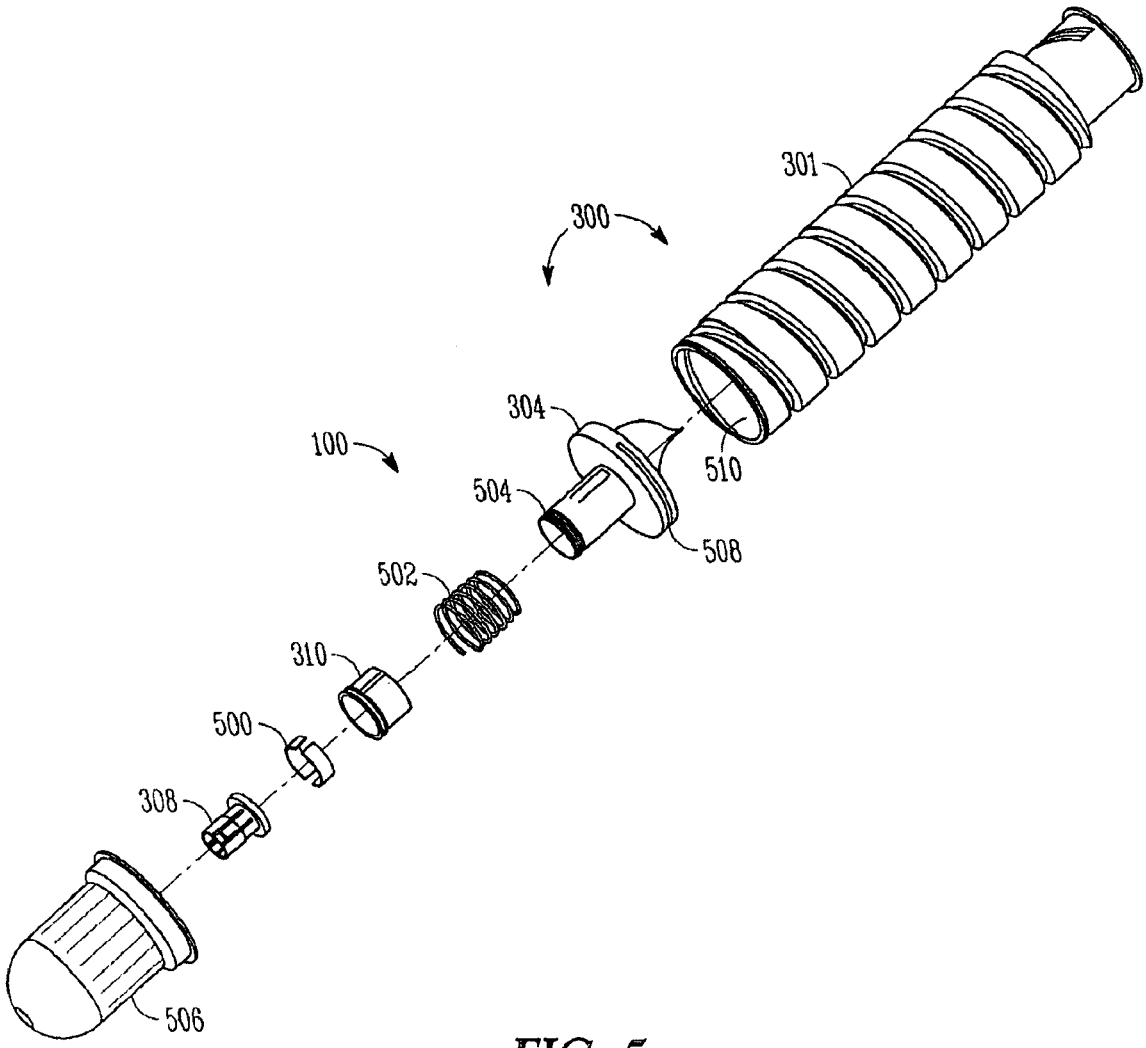
FIG. 5 is an exploded perspective view of another example of the toner cartridge.

FIG. 5 shows the toner cartridge 100 components in an exploded view. As described above, the toner cartridge includes a container body 300 for containing toner. The container body 300 includes a neck portion 304 having a smaller diameter that funnels the toner toward a discharge opening (e.g., discharge opening 400 shown in FIG. 4). The collar 310 moves along the neck portion 304 to close and open the discharge opening 400. In one example, a gasket 500 is interposed between the collar 310 and the neck portion 304 to enhance the seal between the collar 310 and the neck portion 304 while the collar 310 closes the discharge opening 400. Optionally, the gasket 500 is coupled with at least one of the collar 310 and the neck portion 304. The toner cartridge 100, in another example, includes a biasing element 502 coupled between the container body 300 (e.g., the neck portion 304) and the collar 310. The biasing element 502 biases the collar 310 toward the first closed position shown in FIG. 3 and maintains the collar in the closed position to prevent undesired leaking of the toner. The biasing element 502 thereby ensures the toner cartridge 100 remains in the closed position when not coupled with the toner hopper 102 instead of possibly remaining open (or accidentally being pulled open, such as during removal of the cartridge 100 from the machine) when not so coupled, for instance, during transport, storage and the like. The biasing element 502, in yet another example, is a coiled spring. In still another example, the biasing element 502 includes, but is not limited to, an elastomer, such as rubber, foam rubber, opposing magnets and the like.

The neck portion 304, in one example, includes a recess 504 sized and shaped to receive the drive transmitting member 308. The recess 504 includes features, such as threading, fasteners, adhesives and the like to fixedly couple the drive transmitting member 308 with the neck portion 304 of the container body 300. In another example, the drive transmitting member 308 couples with the neck portion 304 and the perimeter of both pieces are substantially flush with each other. Optionally, the flush surface between the drive transmitting member 308 and the neck portion 304 permits sliding movement of the collar 310 over the neck portion 304 and at least a portion of the drive transmitting member 308. FIG. 5, further shows a cap 506 sized and shaped to couple over at least the drive transmitting member 308, collar 310 and a portion of the neck portion 304. The neck portion 304, in yet another example, includes threading 508 engageable with corresponding threading on the interior of the cap 506 to retain the cap 506 on the toner cartridge 100 until the cartridge is coupled with the toner hopper 102 (FIGS. 1 and 2).

Figure 7:
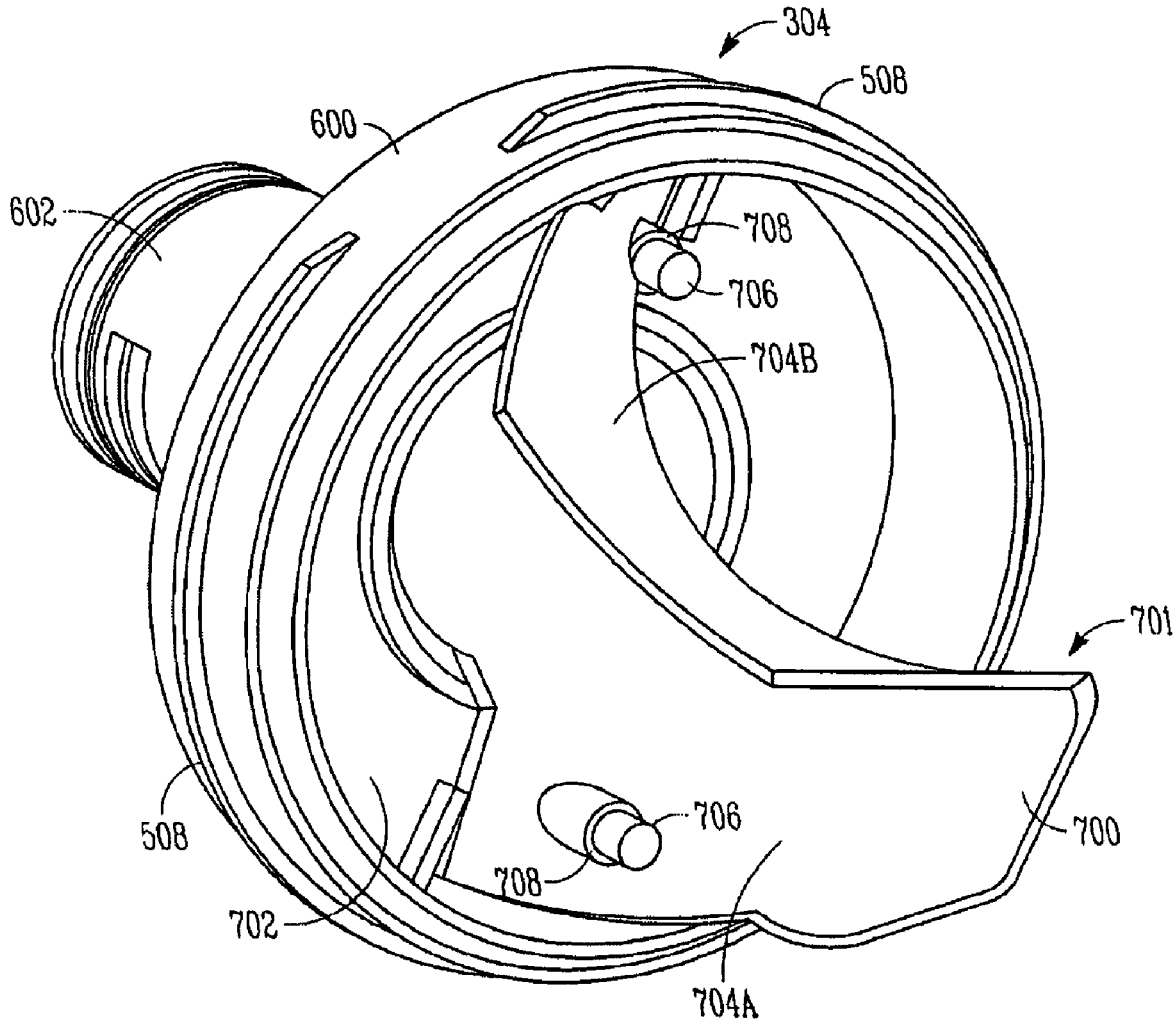
FIG. 7 is another perspective view of the neck portion of the container body including one example of a toner feeding blade.

FIGS. 6 and 7 show the neck portion 304 of the container body 300 (FIG. 3). As described above, in one example, the neck portion 304 is coupled between the drive transmitting member 308 and the rest of the container body 300 (FIGS. 3 and 4). The neck portion 304 includes a base 600 and a neck 602. The neck 602 and base 600 are integrally formed, in another example, for instance, by injection molding. The base 600 is sized to couple with the storage portion 301 (FIGS. 3, 4 and 5) of the container body 300. Optionally, the storage portion 301 is filled with toner through a toner filling orifice 510 (FIG. 5) prior to being coupled with the base 600. The base 600 includes, in yet another example, threading 508 for coupling with the cap 506 (FIG. 5). The neck 602 has a smaller perimeter than the base 600 and the storage portion 301, and is sized for receipt within the drive transmitting member orifice 110 shown in FIG. 1. The recess 504 is optionally formed distal to the discharge opening 400, and as described above is sized to receive the drive transmitting member 308. As shown in FIG. 6, the neck 602 includes threading 604 corresponding to threading along the interior of the drive transmitting member 308, in still another example. In one option, the neck portion 304 (including the neck 602 and/or the base 600) with the collar 310, the biasing element 502 and the drive transmitting member 308 are packaged together for use with a separately manufactured or remanufactured container body 300 (such as storage portion 301). For instance, the neck portion 304, collar 310, biasing element 502 and the drive transmitting member 308 are sold separately from the container body 300 and thereafter coupled with the body 300 to form the cartridge 100.

The neck portion 304 guides the collar 310 (FIGS. 3 and 4) along the neck 602 between the first closed position (FIG. 3) and the second open position (FIG. 4) to open the discharge opening 400. In one example, the neck 602 includes at least one of a slot and guide projection and the collar 310 includes a corresponding projection or slot. As shown in FIG. 6, the neck 602 includes a guide projection 606 sized to fit within a slot in the collar 310 (described below). Additionally, the neck 602 includes, in another example, ridges 608 that sandwich a corresponding stud on the collar 310 (also described below). Optionally, the stud is interposed between the ridges 608 and thereby substantially prevented from rotating around the neck 602.

Referring now to FIG. 7, the neck portion 304 further includes a toner feeding blade 700 coupled along an interior surface 702 of the neck portion 304. The toner feeding blade 700 is sized and shaped to communicate with the feeding members 302, such as spiral projections within the storage portion 301 of the container body 300 (FIGS. 3 and 4) at a first feeding blade end 701. The toner feeding blade 700 scoops toner advanced by the feeding members 302 through rotation of the toner cartridge 100 and guides it toward the toner discharge opening 400 (FIG. 6) near a second feeding blade end 703. Optionally, the toner feeding blade 700 extends through the neck 602 at least to the discharge opening 400, as shown in FIG. 6. As shown in FIGS. 6 and 7, in one example, the toner feeding blade 700 has a helical configuration that facilitates the guidance of toner along both sides 704A, B of the feeding blade 700 during rotation of the toner cartridge 100. The toner feeding blade 700 is coupled with the neck portion 304 interior surface 702 in a variety of means, including, but not limited to, adhesives, welding, mechanical fastening and the like. For example, as shown in FIG. 7, the toner feeding blade 700 is coupled to the interior surface 702 with a set of pins 706 extending from the base 600 that are received within corresponding cavities 708 in the feeding blade 700.

Figure 8:
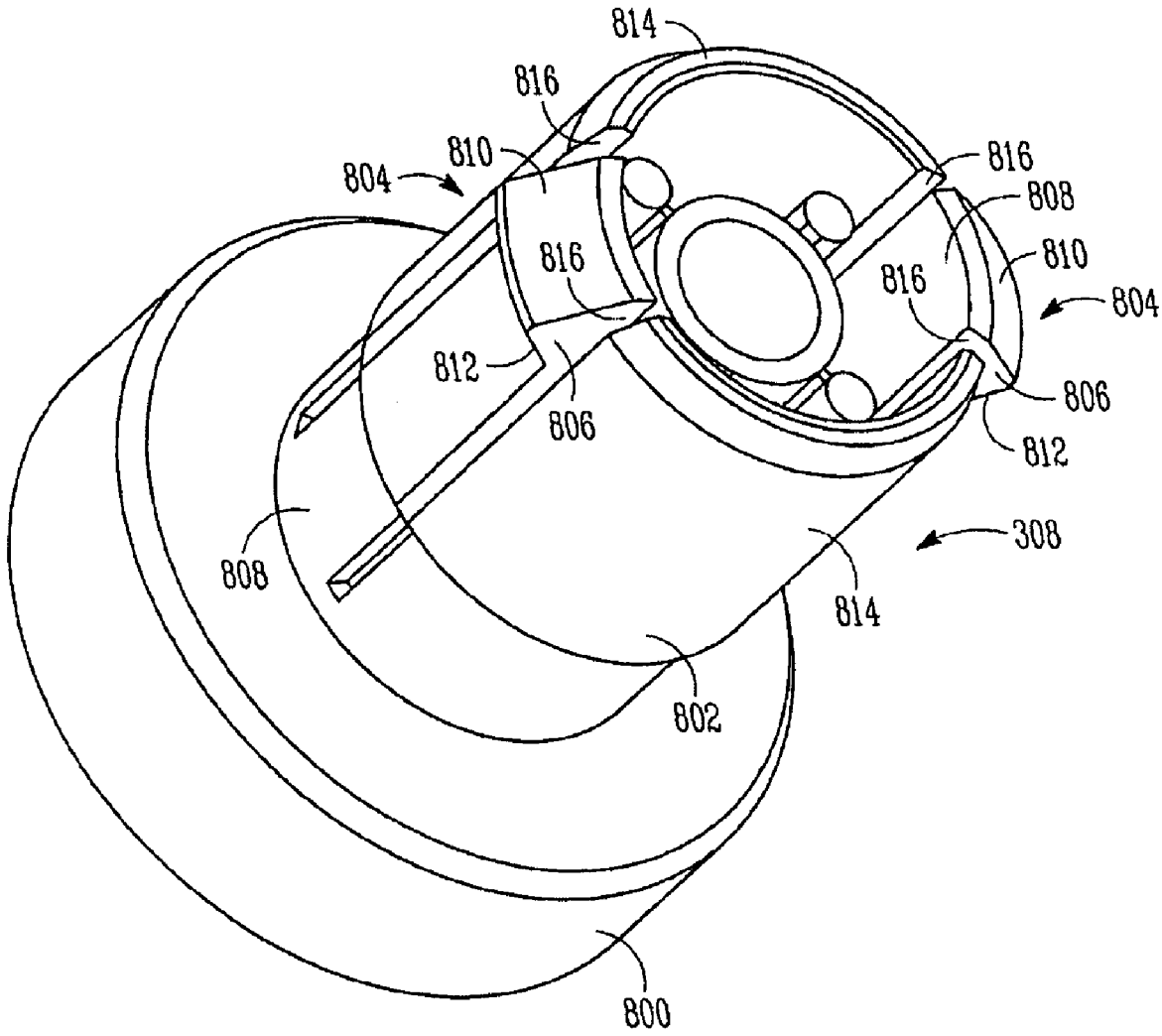
FIG. 8 is a perspective view of one example of a drive transmitting member.

FIG. 8 shows one example of the drive transmitting member 308. As shown, the drive transmitting member 308 includes a coupling skirt 800 sized for coupling with the neck 602 of the neck portion 304 (FIG. 6). The drive transmitting member 308 is fixedly coupled with the neck portion 304 of the container body 300 and is substantially prevented from rotating with respect to the container body 300. In one example, the drive transmitting member 308 is coupled with the neck portion 304 after the container body 300 is filled with toner through the neck portion 304, for instance through a toner filling orifice 610, shown in FIG. 6. The drive transmitting member 308 further includes a drive receiver 802 sized for receipt within the drive coupling 112 (FIG. 1) of the image forming apparatus. The drive receiver 802 receives rotational driving forces from the image forming apparatus drive coupling 112 and transmits those forces to the container body 300 through the fixed coupling between the coupling skirt 800 and the neck portion 304.

The drive receiver 802, in one example, includes at least one ramped drive element 804 having features sized and shaped to engage with ribs 114 of the drive coupling 112 (FIG. 1). In the example, shown in FIG. 8, the drive receiver includes dual ramped drive elements 804. As shown in FIG. 8, the ramped drive element 804 includes at least one driving face 806. The driving face 806 engages against the rib 114 to receive the rotation forces from the drive coupling 112. The ramped drive element 804 includes a first ramp face 810 and a second ramp face 812. The first and second ramp faces 810, 812 permit sliding movement of the drive transmitting member 308 into the drive coupling 112. As shown in FIG. 8, the first and second ramp faces 810, 812 are opposed and thereby provide a sloped contour for the rim 116 to ride over, as described below. The ramped drive element 804 is formed along a deflectable support member 808 of the drive receiver 802. In another example, the first and second ramp faces 810, 812 are sloped with respect to the support member 808, for instance, the ramp faces 810 extend at angles and are not parallel or perpendicular to the support member 808.

In operation, as the drive transmitting member 308 is inserted into the drive coupling 112 of the image forming apparatus the first ramp face 810 engages with the rim 116 of the drive coupling (FIG. 1) and deflects the support member 808. The deflectable support member 808 returns to its original orientation (shown in FIG. 8) as the drive transmitting member 308 is further inserted into the drive coupling 112 and the second ramp face 812 slides over the rim 116. In one example, the driving face 806 of the ramped drive element 804 is thereby positioned adjacent to the rib 114, and with turning of the drive coupling 112, the rib 114 engages with the driving face 806 to allow for transmission of rotation to the toner cartridge 100 (FIG. 1). In another example, the ramped drive element 804 is positioned underneath the rib 114 after insertion into the drive coupling 112. As the drive coupling 112 rotates, the rib 114 moves with respect to the ramped drive element 804 and the element 804 springs back into its original orientation for engagement with the rib 114 as the rib continues its rotation. During removal of the toner cartridge 100 (FIG. 1) from the image forming apparatus, the second ramp face 812 slides under the rim 116 and the support member 808 deflects until the first ramp face 810 slides over the rim 116. The drive transmitting member 308 is thereby held within the drive coupling 112 solely for rotation of the cartridge 100, and is not otherwise locked in place (e.g., with fasteners, such as clamps, snap-hook features and the like). Because the drive transmitting member 308 is not locked within the drive coupling 112 the drive transmitting member 308 does not need releasing features and construction costs and labor are minimized.

Referring again to the deflectable support members 808 shown in FIG. 8, the members 808 are constructed with sufficient strength to resist deflection along the circumference of the drive receiver 802. For example, the deflectable support members 808 have enhanced width, thickness, reinforced materials and the like to transmit the rotational forces from the drive coupling 112 to the rest of the cartridge 100. The deflectable support members 808 are separated by gaps 816 from guide members 814. The guide members 814 assist with insertion of the drive receiver 802 into the drive coupling 112. The gaps 816 facilitate the radial deflection of the deflectable support members 808 during insertion of the drive receiver 802 in the drive coupling 112. Because of the robust construction of the support members 808, during rotation of the cartridge 100 (FIG. 100) the deflectable support members 808 do not engage with the guide members 814 (i.e., by deflection along the drive receiver 802 circumference). Instead, the deflectable support members 808 deflect radially (as opposed to circumferentially) while engaged with the rim 116 (FIG. 1) during insertion of the drive receiver 802.

Figure 9:
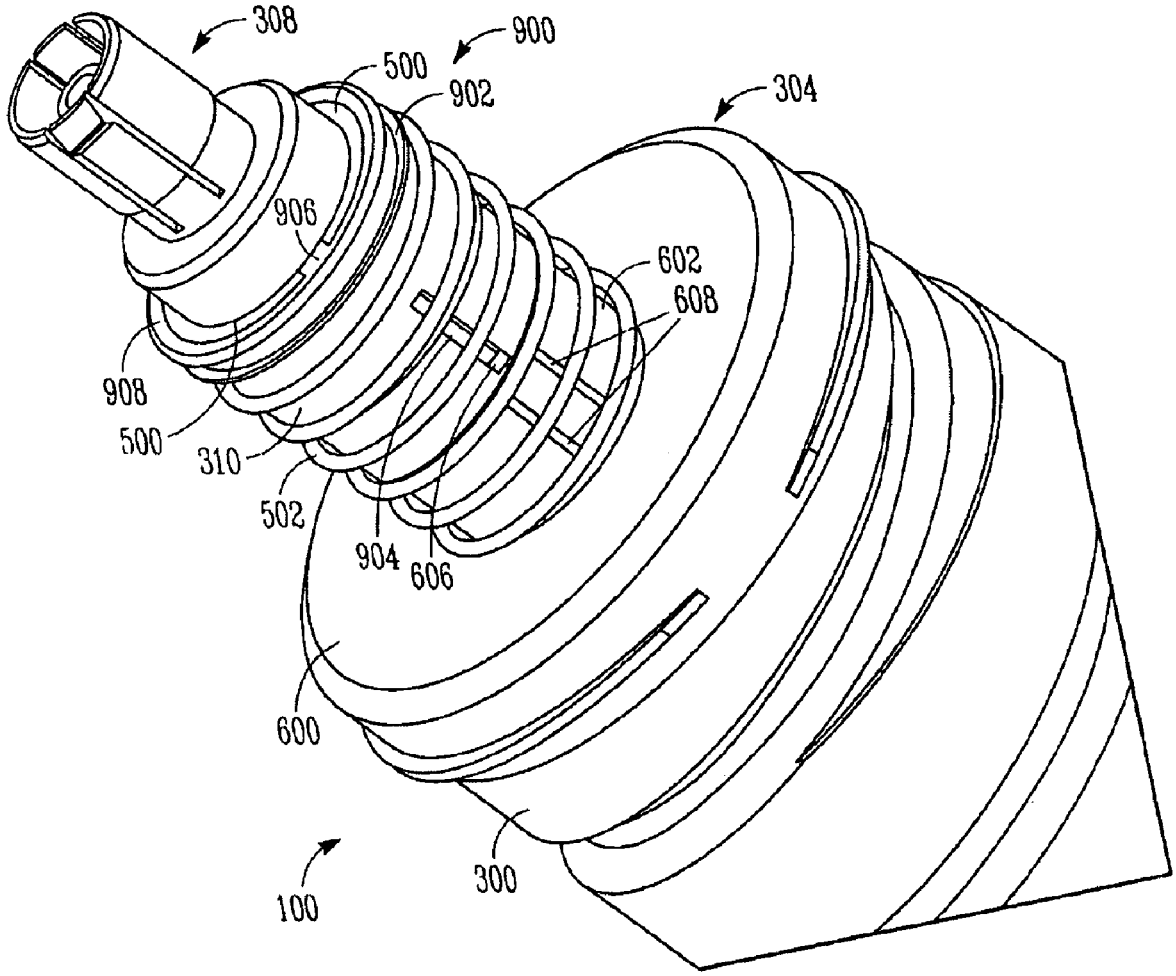
FIG. 9 is a detailed perspective view of the toner cartridge including the container body, collar and drive transmitting member.

FIG. 9 shows a detailed perspective view of the assembled toner cartridge 100 near the drive transmitting member 308. As shown, the drive transmitting member 308 is coupled with the neck 602 of the neck portion 304. In one example, the collar 310 is coupled around at least a portion of the neck 602. The collar 310, in FIG. 9, is shown extending entirely around the neck 602. The collar 310 is shown in the first closed position (See also FIGS. 1 and 3), and the biasing element 502 urges the collar 310 toward this position. The biasing element 502 extends between the neck portion base 600 and a distal end 900 of the collar 310. In one example, the distal end 900 of the collar 310 includes a biasing element ridge 902 sized to receive the biasing element 502 and retain the element 502 between the collar 310 and the base 600 of the neck portion 304. The collar 310, optionally, is retained along the neck 602 with the projections 606 and slots 904 sized to receive the projections 606. The collar 310 slides along the projections 606, in another example. The projection 606 engages with the collar 310 at the end of the slot 904 to substantially prevent the collar 310 from sliding off the neck 602, as shown in FIG. 9. Additionally, as shown in FIGS. 6 and 9, the neck 602 includes ridges 608 that retain a stud 906 of the collar 310 therebetween. In yet another example, the projections 606, slots 904, ridges 608 and studs 906 cooperate to ensure the collar 310 does not rotate around the neck 602. The interior of the collar 310 includes the gasket 500, in still another example, and the non-rotatable collar 310 ensures the gasket 500 is retained over the discharge opening 400 (FIG. 4) in the closed position and prevents leaking of toner.

Referring again to FIG. 9, the collar 310 includes an engaging surface 908 sized to engage with the toner hopper 102 of the image forming apparatus. As shown in FIG. 1, the toner hopper 102 includes an engagement ring 108 that abuts the engaging surface 908. Contact between the engagement ring 108 and the engaging surface 908 during insertion of the drive transmitting member 308 into the toner hopper 102 overcomes the bias of the biasing element 502 and moves the collar 310 toward the storage portion 301 of the container body 300 (FIG. 4). As shown in FIG. 4, when the collar 310 is moved into the second position, the discharge opening 400 are exposed and toner may be dispensed. The discharge opening 400 is thereby automatically opened as the drive transmitting member 308 is inserted into the drive coupling 112 because of the engagement between the engagement ring 108 and the engagement surface 908. Conversely, the discharge opening 400 is automatically closed as the drive transmitting member 308 is pulled out of the drive coupling 112 and biasing element 502 moves the collar 310 over the opening 400. The discharge opening 400 is automatically closed even where the image forming apparatus malfunctions and is unable to otherwise act on the cartridge 100, as opposed to prior toner cartridge designs that require interaction with the apparatus to open and close the cartridge.

As shown in FIG. 2, the toner cartridge 100 is retained in the toner hopper 102 through engagement of the locking lever 200 with the cartridge proximal end 202. The cartridge 100 is sized between the cartridge proximal end 202 and the engaging surface 908 of the collar 310 (e.g., see distance 204 in FIG. 2), so the collar 310 is moved to the second open position shown in FIG. 4 when the cartridge 100 is locked in place with the locking lever 200. The discharge opening 400 is thereby opened by the engagement between the locking lever 200 and the cartridge proximal end 202 and the abutment between the engaging surface 908 and the engagement ring 108. Engagement of the drive transmitting member 908 with the drive coupling 112 is thereby not used to move the collar 310 and open the discharge opening 400. Because the collar 310 is opened through engagement of the proximal end 202 and the engaging surface 908 with the image forming apparatus, it is not necessary to uncouple the drive transmitting member 308 from the toner cartridge 100. Additionally, increased design and manufacturing of a removable drive transmitting member is eliminated. Furthermore, the drive transmitting member 308 does not experience enhanced stresses at supports extending between the member 308 and the neck portion 304. Instead, the drive transmitting member 308 is fixedly coupled with the neck portion 304 providing a more secure mechanism to transmit rotation to the cartridge 100 while still allowing opening of the discharge opening 400 through the collar 310.

Figure 10:
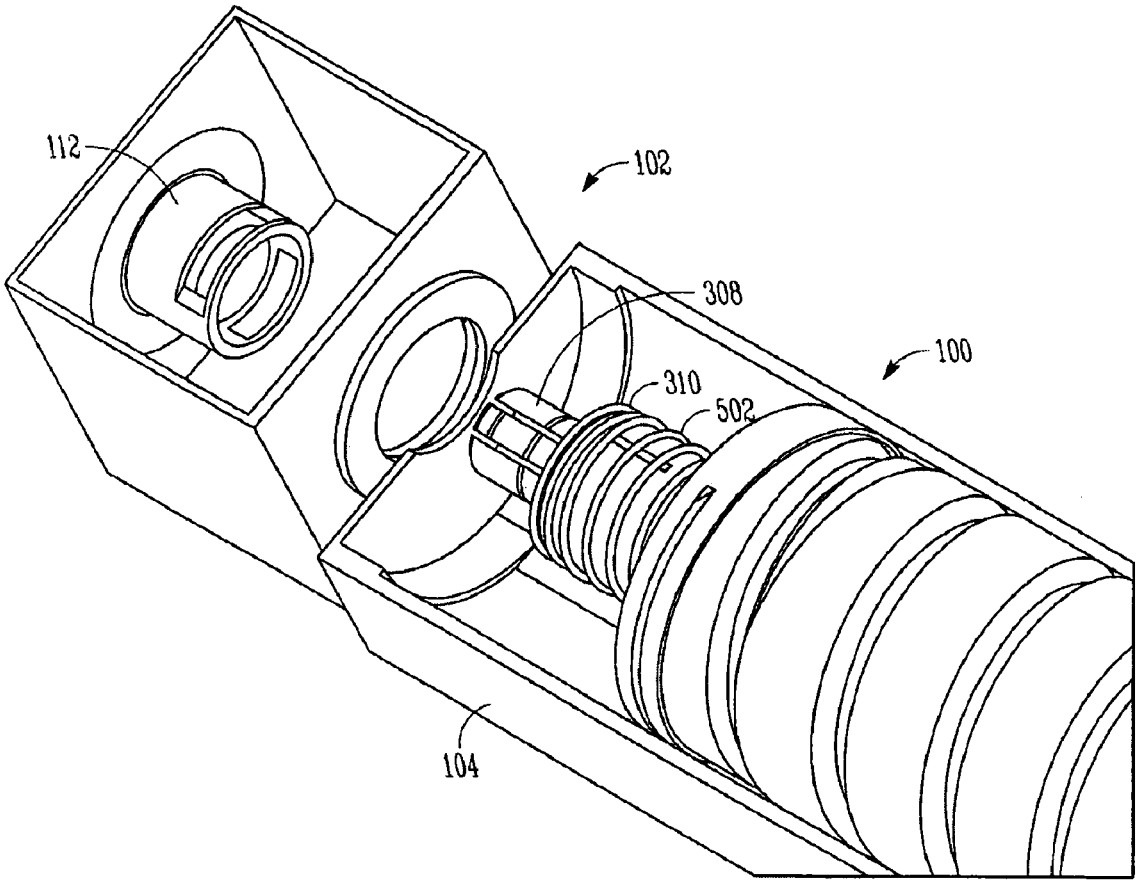
FIG. 10 is a detailed perspective view of the toner cartridge prior to coupling with a toner hopper.
Figure 11:
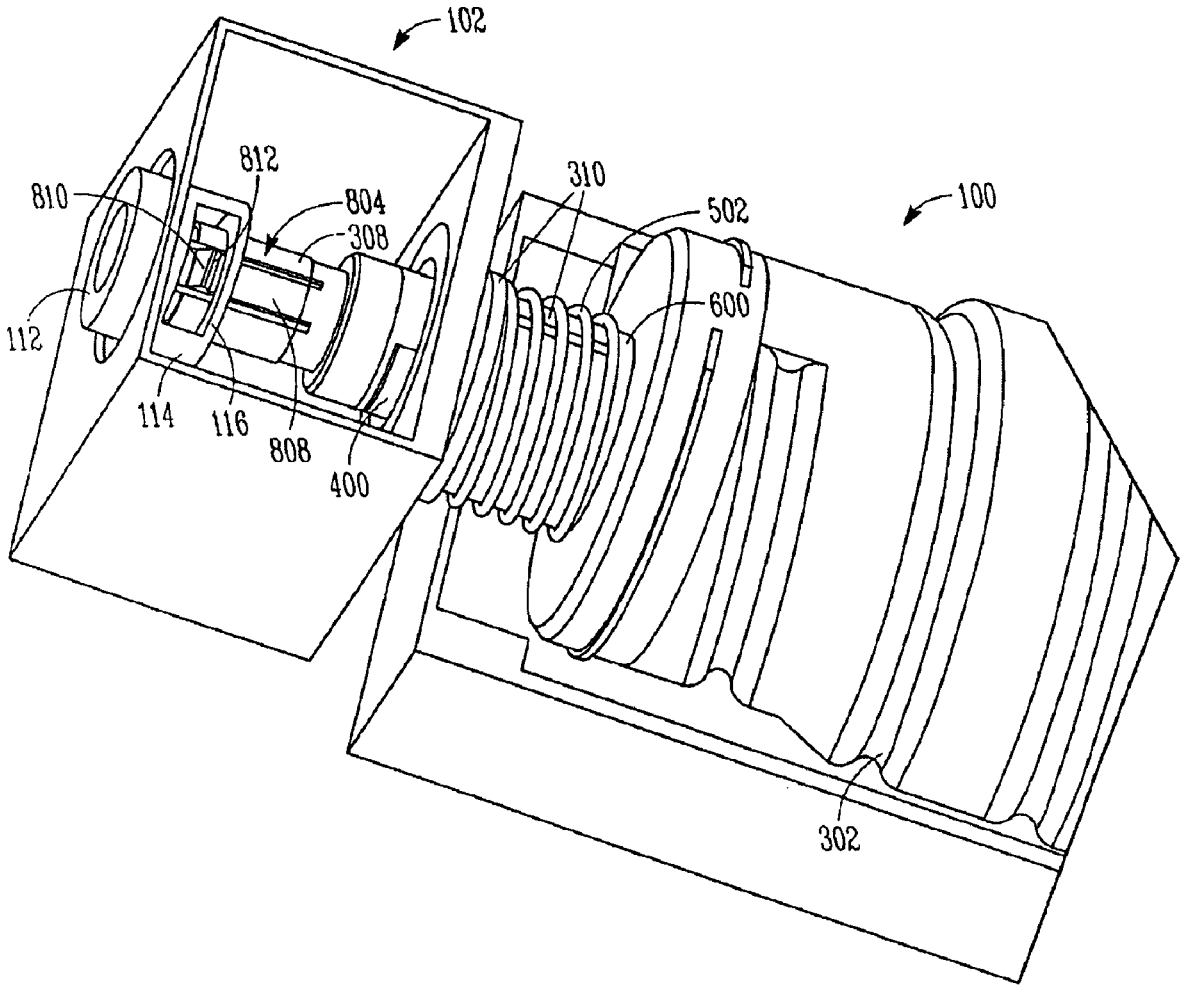
FIG. 11 is a detailed perspective view of the toner cartridge coupled with a toner hopper.

Referring now to the detailed perspective view of the toner cartridge 100 and the toner hopper 102 in FIG. 10, the cartridge 100 is shown just prior to fitting the drive transmitting member 308 within the drive coupling 112. In operation, the toner cartridge 100 is placed within the machine, for instance, on the cartridge tray 104, and moved toward the toner hopper 102. The collar 310 is in the first closed position and held in place over the discharge opening 400 (FIG. 4) with the biasing element 502. As shown in FIG. 11, the drive transmitting member 308 of the toner cartridge 100 is inserted into the drive coupling 112. As previously described the first and second ramp faces 810, 812 of the ramped drive element 804 slide underneath the rim 116 of the drive coupling 112 as the support member 808 is deflected. As the second ramp face 812 finishes sliding underneath the rim 116, the ramped drive element 804 resumes its undeflected state and the driving face 806 of the element is positioned for engagement with the rib 114. The collar 310 is moved through abutment of the engaging surface 908 (FIG. 9) with the engagement ring 108 (FIG. 1) of the toner hopper 102. The collar 310 is moved along the neck 600 to a second open position exposing the toner discharge opening 400. The insertion of the toner cartridge 100 overcomes the force provided by the biasing element 502 and allows the collar 310 to move and uncover the discharge opening 400. As shown in FIG. 2 and described above, the locking lever 200 is lowered into position behind the cartridge proximal end 202 to lock the cartridge 100 in place and retain the collar 310 in the second open position. The image forming apparatus then rotates the toner cartridge through the drive coupling 112, as shown in FIG. 11. The drive coupling ribs 114 engage with the driving face 806 and turn the toner cartridge 100. As the cartridge 100 is turned, toner is moved by the feeding member 302 (e.g., a spiral projection) toward the toner discharge opening 400. The toner feeding blade 700, shown in FIG. 7, guides the toner from the feeding member 302 to the discharge opening 400 where the toner is discharged out of the opening 400 and into the toner chute 106 of the hopper 102.

Removal of the toner cartridge 100 from the toner hopper 102 is accomplished by performing the above described steps substantially in reverse. The locking lever 200 is disengaged from the cartridge proximal end 202 and the toner cartridge 100 is pulled away from the toner hopper 102. The second ramp face 812 slides under the rim 116 followed by the first ramp face 810, thereby disengaging the drive transmitting member 308 from the drive coupling 112. The biasing element 502 moves the collar 310 over the neck 600 and covers the discharge opening 400 in the first closed position.

Figure 12:
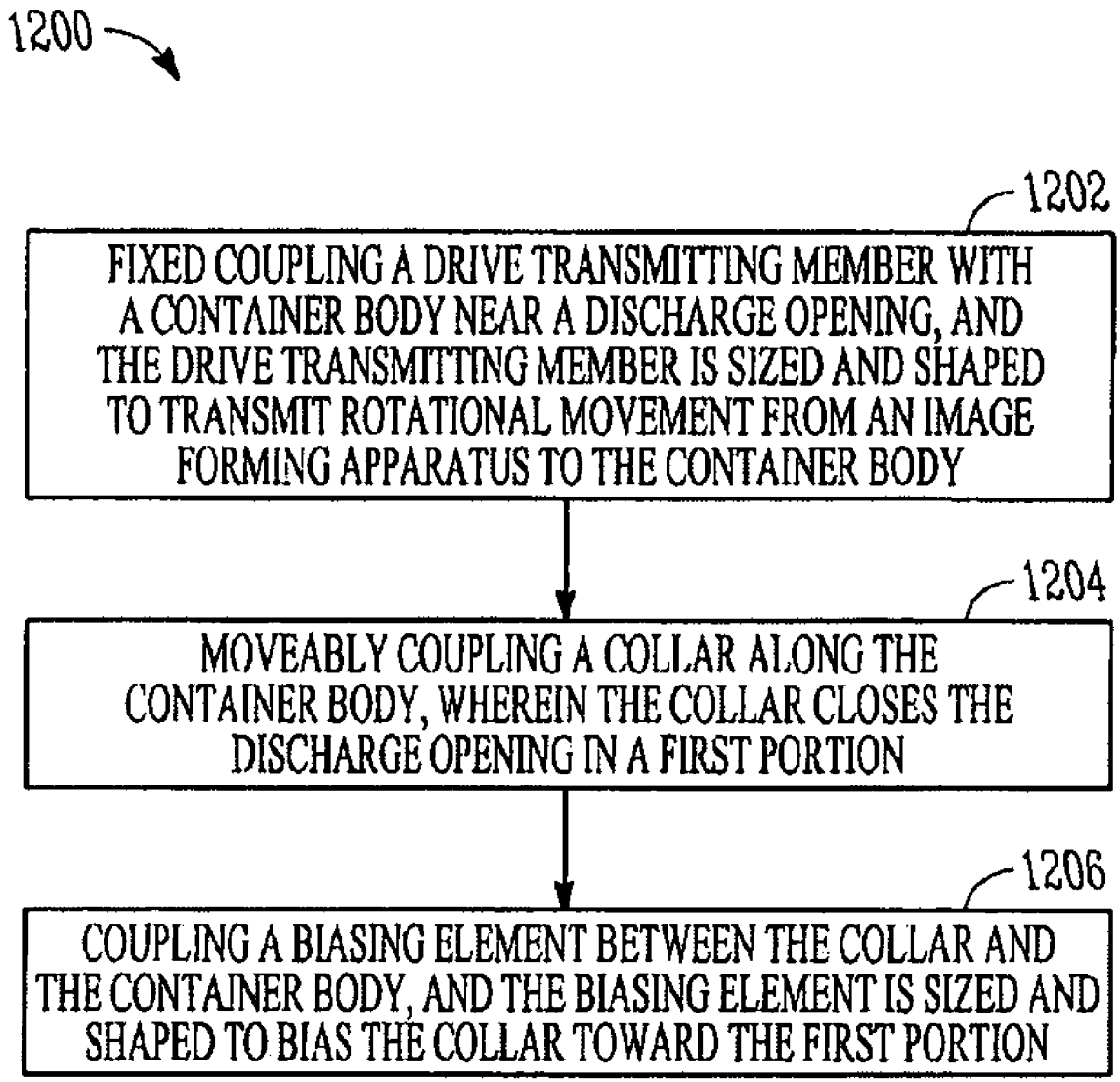
FIG. 12 is a block diagram showing one example of a method for making a toner cartridge.

FIG. 12 shows one example of a method 1200 for making a toner cartridge. One example of a toner cartridge, such as toner cartridge 100, is shown in FIGS. 1-11 and referenced below. At 1202, a drive transmitting member 308 is fixedly coupled with a container body 300 near a discharge opening 400. The drive transmitting member 308 is sized and shaped to transmit rotational movement from an image forming apparatus (e.g., a drive coupling 112) to the container body 300. At 1204, a collar 310 is movably coupled along the container body 300 (for instance along the neck portion 304). The collar 310 closes the discharge opening 400 in a first position. At 1206, a biasing element 502 is coupled between the collar 310 and the container body 300. The biasing element 502 is sized and shaped to bias the collar 310 toward the first position.

Several options for the method 1202 follow. In one example, the container body 300 is blow molded. In another example, the method 1200 includes forming at least one deflectable support member 808 on the drive transmitting member 308. Optionally, the deflectable support member 808 includes a ramped drive element 804. Forming the at least one deflectable support member includes, in yet another example, forming the ramped drive element 804 with a first ramp face 810, a second ramp face 812, and at least one driving face 806. In still another example, the method 1200 includes filling the toner cartridge 100 with toner through a toner filling orifice (e.g., orifices 510 and 610) in the container body 300 prior to fixedly coupling the drive transmitting member 308 with the container body, wherein the drive transmitting member 300 at least partially conceals the toner filling orifice.

In another example, coupling the biasing element 502 between the collar 310 and the container body 300 includes coupling the collar 310 around a neck portion 304 (including a neck 600) of the container body. In still another example, moveably coupling the collar 310 along the container body 300 includes sizing the container body 300 between a first container body end (e.g., proximal end 202) and an engaging surface 908 (engageable with the engagement ring 108 of the toner hopper 102) of the collar 310 to maintain the collar 310 in a second position that opens the discharge opening 400, as shown in FIG. 11.

The examples of toner cartridges described herein provide a reliable and cost effective cartridge for use with an image forming apparatus. The drive transmitting member is fixedly coupled with the container body and provides a robust strong coupling capable of transmitting rotational forces to the cartridge from the machine. Precise machining and design are not necessary where the drive transmitting member is fixedly coupled with the container and the discharge opening is provided separately from the drive transmitting member.

Additionally, the ramped drive element uses first and second ramp faces to position the drive transmitting member within the drive coupling of the image forming apparatus. Instead of locking the drive transmitting member within the drive coupling and subsequently requiring additional features in the image forming apparatus and on the cartridge to unlock the cartridge from the apparatus, the ramp faces allow for simple insertion and extraction of the cartridge from the apparatus. Moreover, the ramped drive element including the deflectable support member is constructed robustly (e.g., with enhanced width, thickness and the like) to transmit rotational forces from the image forming apparatus to the toner cartridge. Because of the strong construction of the ramped drive elements, the elements do not need additional support from the guide members to absorb stresses created by rotation of the cartridge.

Further, the dimensioning between the cartridge proximal end and the engaging surface ensures the discharge opening concealed by the collar is automatically opened when the cartridge is inserted in the image forming apparatus without needing an opening operation from the apparatus. Removing the cartridge from the toner hopper similarly automatically closes the discharge opening as the collar is moved into the closed position by the biasing element. Complex locking features on the drive transmitting member are thereby eliminated when the cartridge dimensions are used to automatically open and close the discharge opening. Misalignment between a sealing member and the cartridge are avoided because of the automatic closing of the collar over the discharge opening.

The feeding members of the toner cartridge supply toner to the discharge opening at the cartridge distal end. The feeding member, such as a spiral projection extending along the interior of the container body, supplies toner to a feeding blade adjacent to the discharge opening. The feeding member provides an inexpensive means for moving toner toward the opening without requiring a difficultly molded or machined lattice work of bars and projections coupled along the interior of the cartridge.

It is to be understood that the above description is intended to be illustrative, and not restrictive. For example, the above-described embodiments (and/or aspects thereof) may be used in combination with each other. Many other embodiments will be apparent to those of skill in the art upon reviewing the above description. The scope of the invention should, therefore, be determined with reference to the appended claims, along with the fill scope of equivalents to which such claims are entitled. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus the following claims are hereby incorporated into the Detailed Description, with each claim standing on its own as a separate embodiment.

Devices, such as toner cartridges (e.g., cartridges for image forming developer, developing solution and the like) and methods for using and making the same, as claimed herein, can be used and made in conjunction with a variety of devices and systems, for instance image forming apparatuses and devices. Such apparatuses and devices are specifically intended to be considered as illustrative examples of intended use only and therefore are not considered part of the claims. The claims should be interpreted as written without incorporation of apparatuses and devices that show intended use.

What is claimed is:

1. A toner cartridge comprising:

a container body that includes a neck portion having a neck perimeter smaller than the perimeter of a body portion of the container body, wherein the neck portion includes a discharge opening;

a drive transmitting member fixedly coupled with the container body near the discharge opening, and the drive transmitting member is sized and shaped to transmit rotational movement to the container body;

a collar slidable along the length of the neck portion, wherein the collar closes the discharge opening in a first position, and the collar opens the discharge opening in a second position; and a biasing element sized and shaped to bias the collar toward the first position, the biasing element is coupled between the collar and the body portion of the container body, and the biasing element is retained along the neck portion of the container body.

2. The toner cartridge of claim 1, wherein the drive transmitting member is fixedly coupled with the neck portion.

3. The toner cartridge of claim 1, wherein the drive transmitting member includes at least one deflectable support member, and the deflectable support member includes a ramped drive element near a tip of the deflectable support member.

4. The toner cartridge of claim 3, wherein the ramped drive element includes a first ramp face, a second ramp face, and at least one driving face.

5. The toner cartridge of claim 4, wherein the first and second ramp faces are sloped with respect to the deflectable support member.

6. The toner cartridge of claim 1, wherein the collar extends around a neck portion of the container body.

7. The toner cartridge of claim 6, wherein the biasing element includes a coil spring extending over the neck portion and coupled between the collar and the container body.

8. The toner cartridge of claim 1, wherein the collar includes an image forming apparatus engaging surface.

9. The toner cartridge of claim 8, wherein the container body is sized and shaped between a first container body end and the image forming apparatus engaging surface to position the container body within an image forming apparatus and maintain the collar in the second position.

10. A toner cartridge comprising:

a container body that includes a neck portion having a neck perimeter smaller than the perimeter of a body portion of the container body, wherein the neck portion includes a discharge opening;

a drive transmitting member fixedly coupled with the container body near the discharge opening, and the drive transmitting member includes at least one ramped drive element near the tip of a deflectable support member, and each of the at least one ramped drive elements includes a first ramp face, a second ramp face and at least one driving face; and a collar slidable along the length of the neck portion, and the collar extends at least part way around the container body, wherein the collar closes the discharge opening in a first position, and the collar opens the discharge opening in a second position.

11. The toner cartridge of claim 10, wherein the first and second ramp faces are sloped with respect to the deflectable support member.

12. The toner cartridge of claim 10, wherein the drive transmitting member includes at least two ramped drive elements, each of the ramped drive elements is positioned near the tip of separate deflectable support members, and at least one guide member is interposed between the two ramped drive elements, and the at least one guide member is spaced from the two ramped drive elements and the deflectable support member by longitudinal gaps extending between the guide member and each of the at least two ramped drive elements and each of the deflectable support members.

13. The toner cartridge of claim 10, wherein the collar extends around the neck portion of the container body.

14. The toner cartridge of claim 13, wherein at least one of the collar and the neck portion includes a gasket, and the gasket is coupled between the collar and the neck portion.

15. A toner cartridge comprising:

a container body that includes a neck portion having a neck perimeter smaller than the perimeter of a body portion of the container body, wherein the neck portion includes a discharge opening and the container body includes a spiral feeding projection extending along an interior surface of the container body;

a drive transmitting member coupled with the container body near the discharge opening, and the drive transmitting member is constrained from moving relative to the container body;

at least one deflectable support extending from the drive transmitting member, wherein the at least one deflectable support includes at least one ramped drive element positioned near a tip of the deflectable support;

a collar slidable along the length of the neck portion, and the collar extends at least part way around the container body, wherein the collar closes the discharge opening in a first position, and the collar opens the discharge opening in a second position; and a biasing element positioned and configured to bias the collar toward the first position and the biasing element is coupled between the collar and the body portion of the container body.

16. The toner cartridge of claim 15, wherein the ramped drive element includes a first ramp face, a second ramp face, and at least one driving face.

17. The toner cartridge of claim 16, wherein the first and second ramp faces are sloped with respect to the deflectable support.

18. The toner cartridge of claim 15, wherein the collar includes an image forming apparatus engaging surface.

19. The toner cartridge of claim 18, wherein the container body is sized and shaped between a first container body end and the image forming apparatus engaging surface to position the container body within an image forming apparatus and maintain the collar in the second position.

20. The toner cartridge of claim 15, wherein the container body is blow molded.

21. The toner cartridge of claim 15, wherein the drive transmitting member is injection molded.

22. The toner cartridge of claim 15 further comprising a helical feeding blade adjacent to the spiral feeding projection at a first feeding blade end, and a second feeding blade end is adjacent to the discharge opening.

23. An apparatus for a toner cartridge comprising:

a neck including a discharge opening;

a drive transmitting member coupled with the neck near the discharge opening, and the drive transmitting member includes at least one ramped drive element positioned near the tip of a deflectable support member, the deflectable support member extends in a longitudinal direction substantially coincident with a neck longitudinal axis;

a collar slidable along the length of the neck, and the collar extends at least part way around the neck, wherein the collar closes the discharge opening in a first position, and the collar opens the discharge opening in a second position; and a biasing element sized and shaped to bias the collar toward the first position, and the biasing element is engaged between the neck and the collar.

24. The apparatus of claim 23, wherein the neck is sized and shaped to couple with a container body.

25. The apparatus of claim 24 further comprising a container body coupled with the neck.

26. The apparatus of claim 23, wherein the at least one ramped drive element includes at least one driving face.

27. The apparatus of claim 23, wherein the at least one ramped drive element includes a first ramp face and a second ramp face opposed to the first ramp face.

28. The apparatus of claim 23, wherein the drive transmitting member has a larger perimeter than a perimeter of the discharge opening.

29. A method for making a toner cartridge comprising:

fixedly coupling a drive transmitting member with a container body near a discharge opening, and the drive transmitting member is sized and shaped to transmit rotational movement to the container body, wherein the container body includes a neck portion having a neck perimeter smaller than the perimeter of a body portion of the container body;

moveably coupling a collar to slide along the length of the neck portion, wherein the collar closes the discharge opening in a first position; and coupling a biasing element between the collar and the body portion of the container body, the biasing element is retained along the neck portion of the container body, and the biasing element is sized and shaped to bias the collar toward the first position.

30. The method for making the toner cartridge of claim 29 further comprising forming at least one deflectable support member on the drive transmitting member, and the deflectable support member includes a ramped drive element positioned at a tip of the deflectable support member.

31. The method for making the toner cartridge of claim 30, wherein forming the at least one deflectable support member includes forming the ramped drive element with a first ramp face, a second ramp face, and at least one driving face.

32. The method for making the toner cartridge of claim 29, wherein coupling the biasing element between the collar and the container body includes slidably coupling the collar around a neck portion of the container body.

33. The method for making the toner cartridge of claim 29, wherein moveably coupling the collar along the container body includes sizing the container body between a first container body end and an image forming apparatus engaging surface of the collar to maintain the collar in a second position that opens the discharge opening.

34. The method for making the toner cartridge of claim 29 further comprising filling the toner cartridge with toner through a toner filling orifice in the container body prior to fixedly coupling the drive transmitting member with the container body, wherein the drive transmitting member at least partially conceals the toner filling orifice.

* * * * *